US012144436B2

(12) United States Patent
Sheldrick

(10) Patent No.: US 12,144,436 B2
(45) Date of Patent: Nov. 19, 2024

(54) CHILD CARRIER, CHILD SUPPORTING APPARATUS AND RELATED SYSTEM

(71) Applicant: Wonderland Switzerland AG, Steinhausen (CH)

(72) Inventor: Jennifer E. Sheldrick, Malvern, PA (US)

(73) Assignee: Wonderland Switzerland AG, Steinhausen (CH)

( * ) Notice: Subject to any disclaimer, the term of this patent is extended or adjusted under 35 U.S.C. 154(b) by 110 days.

(21) Appl. No.: 16/894,454

(22) Filed: Jun. 5, 2020

(65) Prior Publication Data

US 2020/0383495 A1 Dec. 10, 2020

Related U.S. Application Data

(60) Provisional application No. 62/858,382, filed on Jun. 7, 2019.

(51) Int. Cl.
*A47D 13/02* (2006.01)
*A47D 15/00* (2006.01)

(52) U.S. Cl.
CPC ..... *A47D 13/025* (2013.01); *A47D 15/006* (2013.01)

(58) Field of Classification Search
CPC .... A47D 13/02; A47D 13/025; A47D 15/006; B60N 2/26
USPC ..... 224/158, 161
See application file for complete search history.

(56) References Cited

U.S. PATENT DOCUMENTS

| | | | | |
|---|---|---|---|---|
| 5,205,450 | A * | 4/1993 | Derosier | A47D 13/025 224/161 |
| 5,678,739 | A * | 10/1997 | Darling | A47D 13/025 224/160 |
| 7,686,195 | B2 * | 3/2010 | Bangert | A47D 13/025 224/159 |
| 7,766,199 | B1 * | 8/2010 | Caperon | A47D 13/025 224/159 |
| 8,028,871 | B2 * | 10/2011 | Gray | A47D 13/025 224/159 |
| 8,272,546 | B2 * | 9/2012 | Leistensnider | A47D 13/025 224/158 |
| 9,480,344 | B1 * | 11/2016 | Vialpando | B60N 2/2812 |
| 2004/0149790 | A1 * | 8/2004 | Kassai | A47D 13/02 224/160 |

(Continued)

FOREIGN PATENT DOCUMENTS

| | | |
|---|---|---|
| CN | 201067234 | 6/2008 |
| CN | 104886984 A | 9/2015 |
| CN | 108272279 | 7/2018 |

OTHER PUBLICATIONS

Office Action in corresponding CN patent application No. 202010507687.3 with Chinese and English search reports dated Mar. 30, 2022.

(Continued)

*Primary Examiner* — Derek J Battisti
(74) *Attorney, Agent, or Firm* — NZ CARR LAW OFFICE

(57) ABSTRACT

A child carrier includes a carrying harness installable over a caregiver' torso and shoulders, and a child supporting part operable to attach to and detach from the carrying harness, wherein the child supporting part includes a body support panel and a child attachment connected with each other, the child attachment being operable to attach the child supporting part to a child around the child's waist.

21 Claims, 6 Drawing Sheets

(56) References Cited

U.S. PATENT DOCUMENTS

| | | | | |
|---|---|---|---|---|
| 2007/0029356 | A1 | 2/2007 | Moriguchi et al. | |
| 2012/0298702 | A1* | 11/2012 | Jung | A47D 13/025<br>224/158 |
| 2020/0229615 | A1* | 7/2020 | Cummings | A47D 15/005 |

OTHER PUBLICATIONS

3rd Office Action in corresponding Chinese patent application No. 202010507687.3 with Chinese and English search reports dated Aug. 21, 2023.

Office Action in corresponding CN patent application No. 202010507687.3 with Chinese and English search reports dated Feb. 15, 2023.

* cited by examiner

CHILD CARRIER, CHILD SUPPORTING APPARATUS AND RELATED SYSTEM

CROSS-REFERENCE TO RELATED APPLICATION(S)

This application claims priority to U.S. provisional application No. 62/858,382 filed on Jun. 7, 2019, the disclosure of which is incorporated herein by reference.

BACKGROUND

1. Field of the Invention

The present invention relates to child carriers and systems that include a child supporting apparatus used in combination with a child carrier.

2. Description of the Related Art

Child safety seats and soft child carriers are items frequently used by parents for transporting a child. The child safety seat is useful for transporting a child in a vehicle, whereas the soft child carrier can provide a hand-free way for a caregiver to hold a child close to the caregiver. Generally, transitioning a child from the child safety seat to the soft child carrier requires many steps, and may disturb the child. Moreover, the caregiver has to transport the child carrier separately, which may be bulky and difficult to store.

Therefore, there is a need for an improved child carrier that is more flexible and convenient in use, and can address at least the foregoing issues.

SUMMARY

The present application describes a child carrier that can hold a child close to a caregiver in a hand-free way and reduce disturbance when the child is transitioned between the child carrier and a child supporting apparatus, and a system including a child supporting apparatus adapted to receive the child carrier.

According to an embodiment, the child carrier includes a carrying harness installable over a caregiver' torso and shoulders, and a child supporting part operable to attach to and detach from the carrying harness, wherein the child supporting part includes a body support panel and a child attachment connected with each other, the child attachment being operable to attach the child supporting part to a child around the child's waist.

According to another embodiment, a system is provided, comprising a child safety seat having a seat portion, a child supporting part installable on and removable from the seat portion, wherein the child supporting part includes a body support panel and a child attachment connected with each other, the child attachment being operable to attach the child supporting part to a child around the child's waist, and a carrying harness attachable to and detachable from the child supporting part. The child supporting part is installable on the seat portion separate from the carrying harness, and the child supporting part is attachable to the carrying harness to form a child carrier usable independently of the child safety seat for holding a child close to a caregiver.

DETAILED DESCRIPTION OF THE EMBODIMENTS

Figure 1:
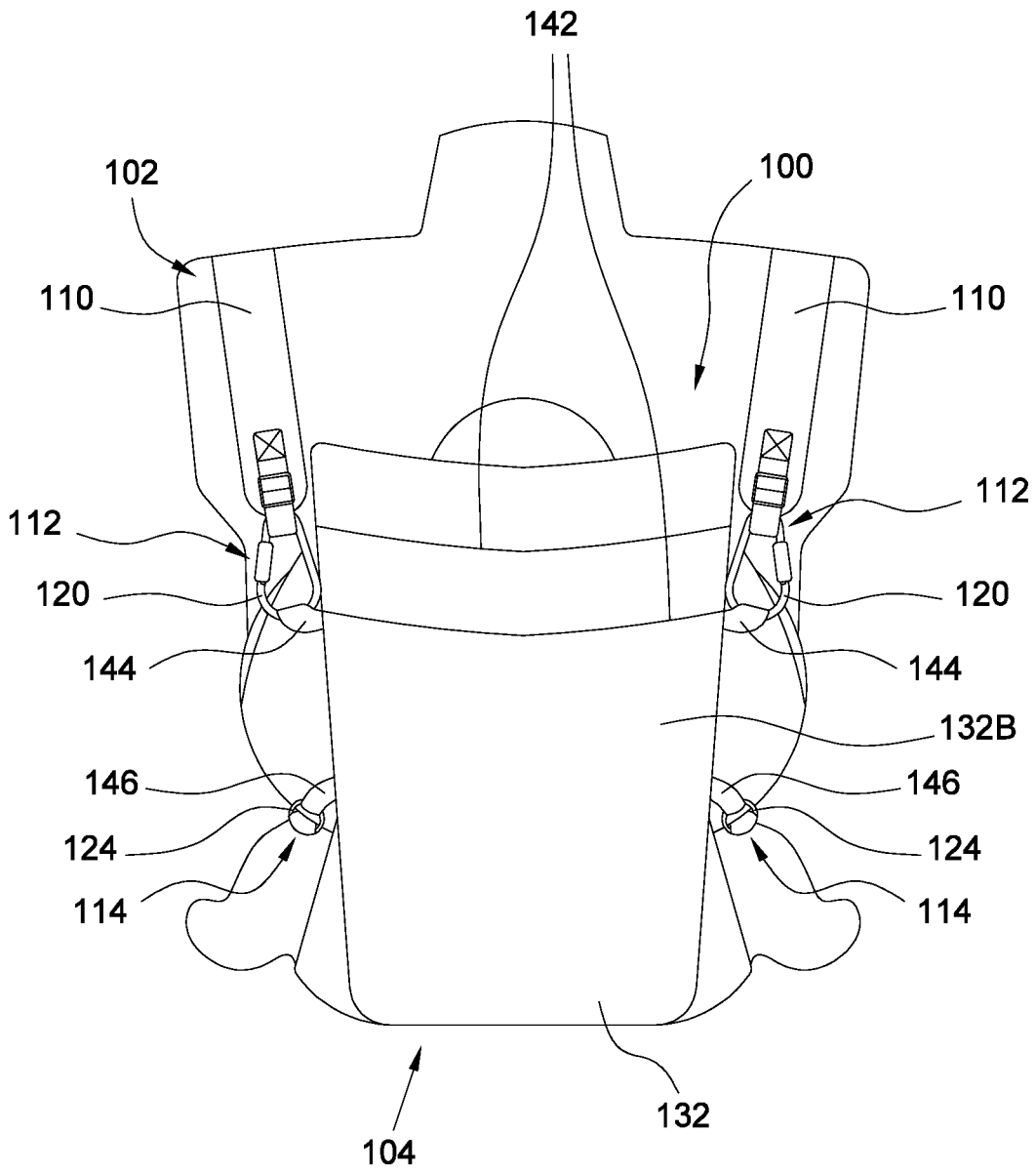
FIG. 1 is a schematic view illustrating an embodiment of a child carrier holding a child in an inward facing position.
Figure 2:
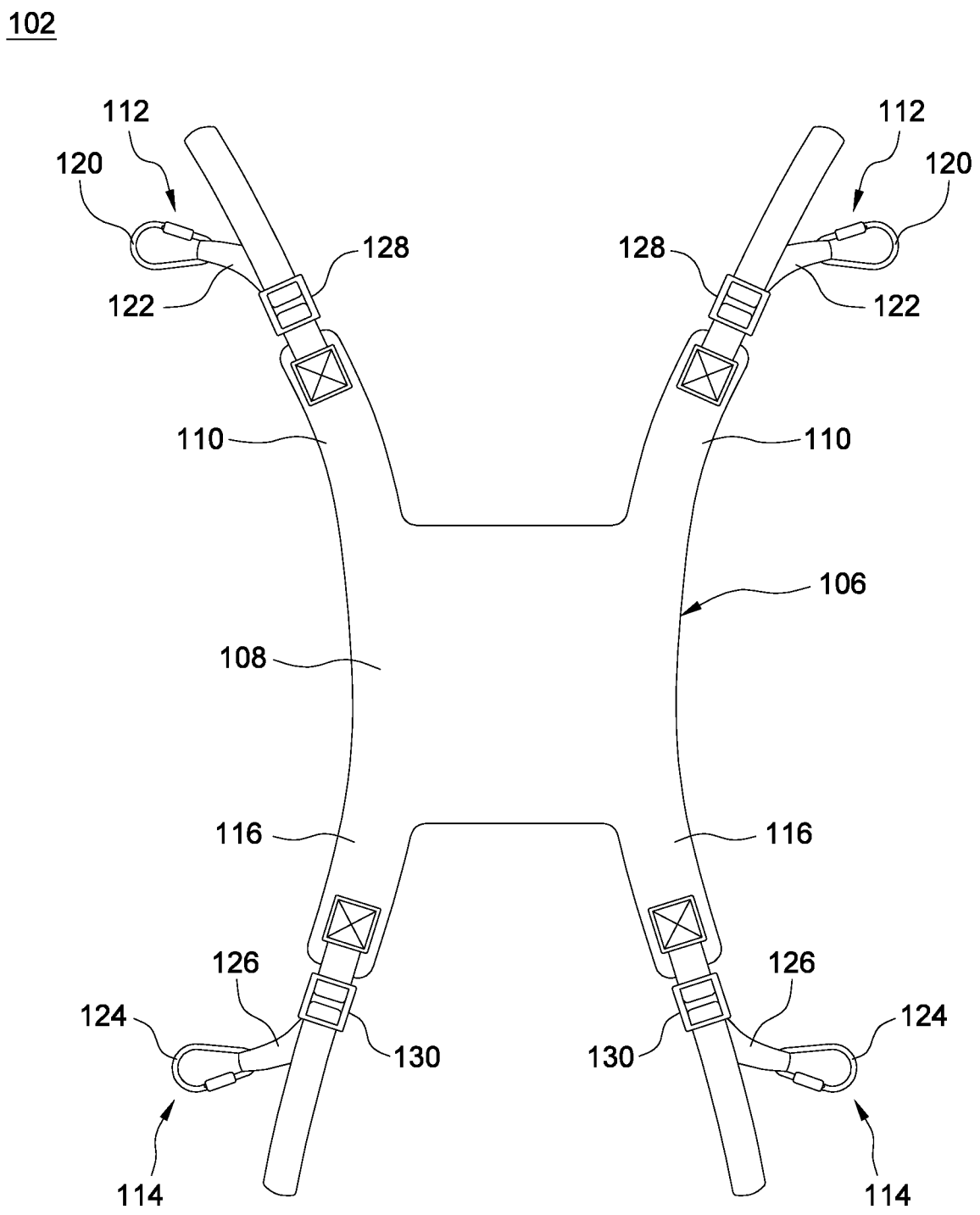
FIG. 2 is a planar view illustrating a carrying harness of the child carrier.
Figure 3:
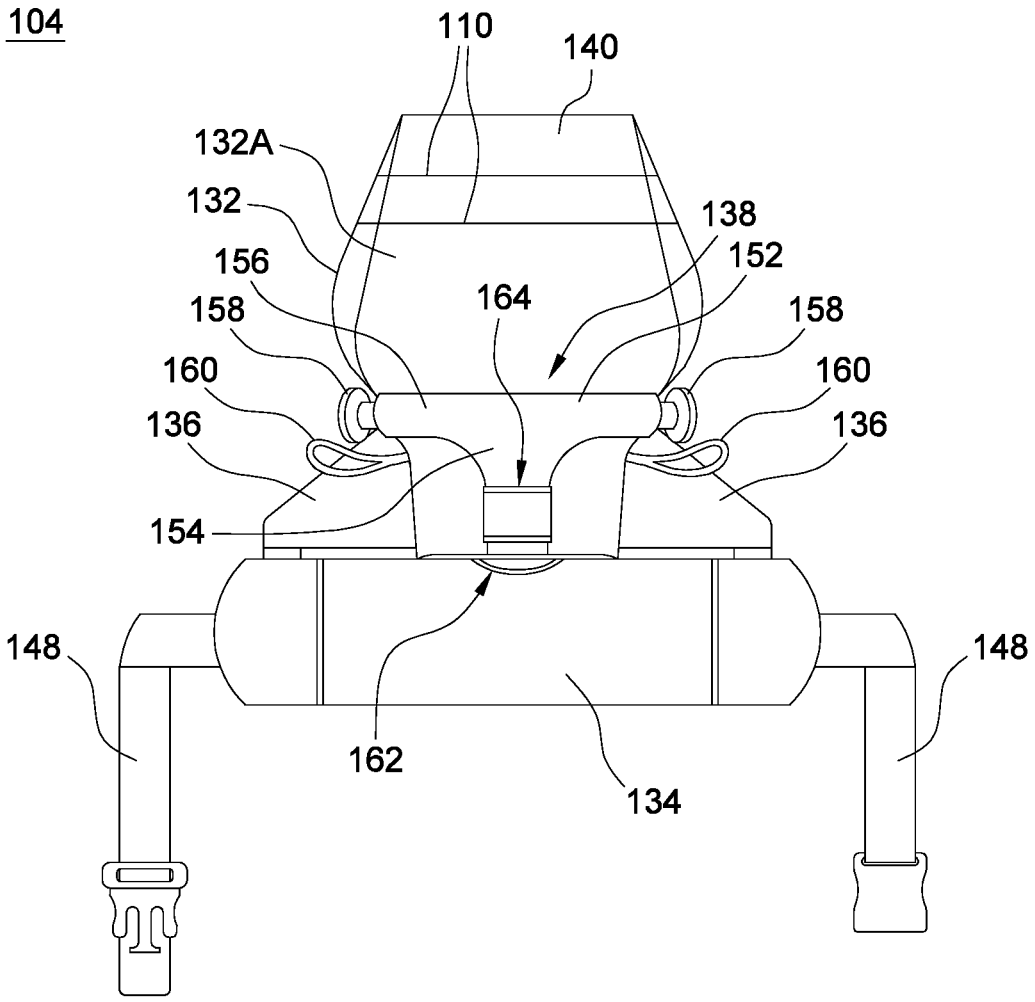
FIGS. 3 and 4 are two planar views illustrating a child supporting part of the child carrier from two opposite sides.
Figure 4:
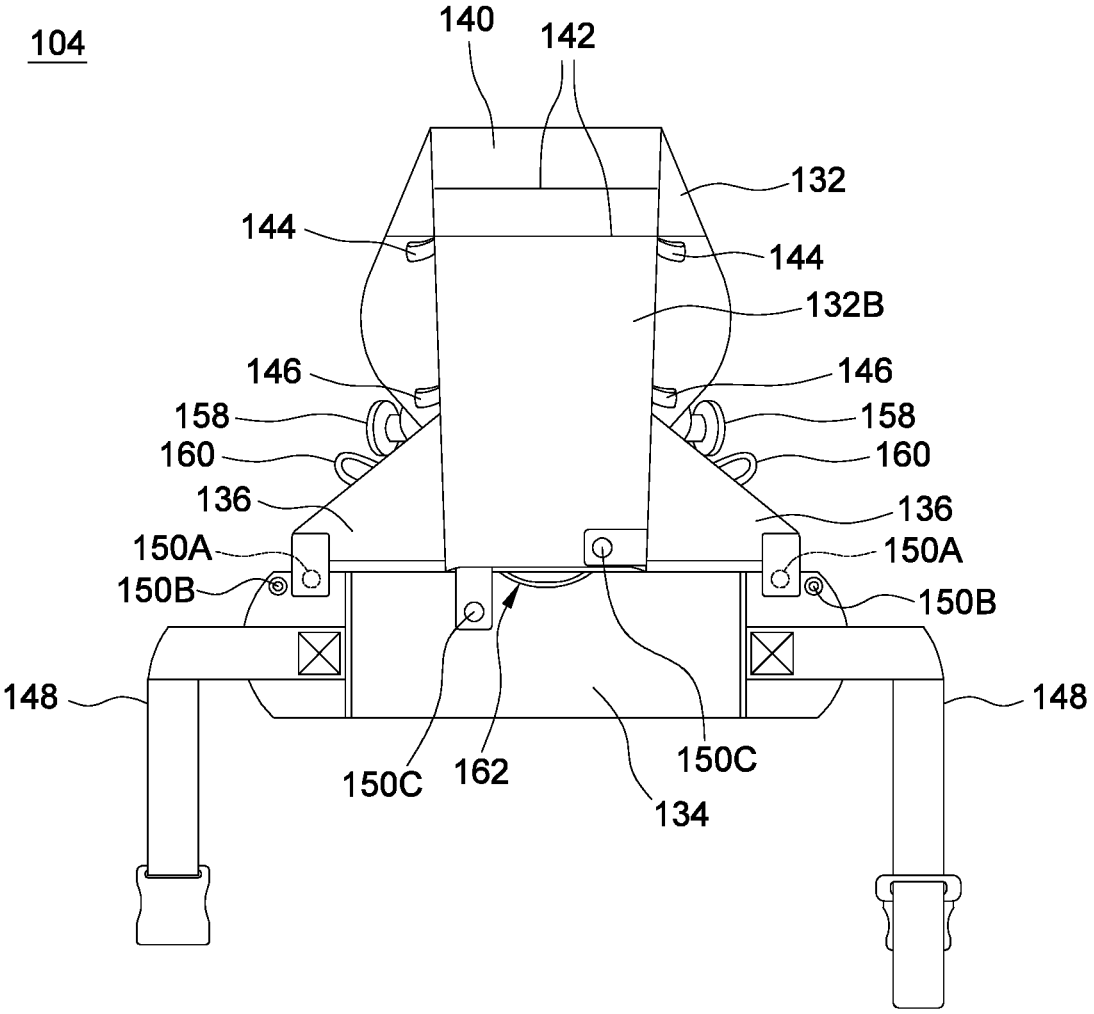

FIG. 1 is a schematic view illustrating an embodiment of a child carrier 100, and FIG. 2 is a planar view illustrating a carrying harness 102 of the child carrier 100, and FIGS. 3 and 4 are two planar views illustrating a child supporting part 104 of the child carrier 100 from two opposite sides. Referring to FIGS. 1-4, the child carrier 100 includes a carrying harness 102 and a child supporting part 104. The carrying harness 102 is installable over a caregiver's torso separate from the child supporting part 104. According to an example of construction, the carrying harness 102 can include a support panel 106 having a back portion 108 and two shoulder extensions 110, the two shoulder extensions 110 projecting from the back portion 108 at a left and a right side thereof. The support panel 106 including the back portion 108 and the two shoulder extensions 110 may be exemplarily provided at a unitary part made of a soft material. When the carrying harness 102 is installed over a caregiver's torso for use, the back portion 108 can be placed on the caregiver's back, and the two shoulder extensions 110 can wrap over the caregiver's shoulders.

Referring to FIGS. 1 and 2, the carrying harness 102 can include a plurality of attaching parts 112 and 114 coupled to the support panel 106 for fastening and unfastening the carrying harness 102 with respect to the child supporting part 104. More specifically, two attaching parts 112 may be respectively coupled to the two shoulder extensions 110, and two attaching parts 114 may be coupled to the back portion 108 at a left and a right side thereof. According to an example of construction, the back portion 108 may have two lower extensions 116 projecting at the left and right side thereof, and the two attaching parts 114 can be respectively coupled to the two lower extensions 116.

The attaching parts 112 and 114 may have any constructions adapted to fasten and unfasten the carrying harness 102 with respect to the child supporting part 104. According to an example of construction, any of the attaching parts 112 and 114 may include a snap link. For example, each of the attaching parts 112 may include a snap link 120 coupled to the corresponding shoulder extension 110 via a strap 122, and each of the attaching parts 114 may include a snap link 124 coupled to the back portion 108 via a strap 126. Adjustment devices 128 and 130 may be provided to respectively adjust the length of the straps 122 and 126 so that the attaching parts 112 and 114 can fasten to the child supporting part 104 at a suitable distance in accordance with the size of the carried child.

Referring to FIGS. 1, 3 and 4, the child supporting part 104 can include a body support panel 132, a waist pad 134, two hip support panels 136 and a child attachment 138. According to an example of construction, the child supporting part 104 including the body support panel 132, the waist pad 134, two hip support panels 136 and the child attachment 138 may be provided as a unitary part.

The body support panel 132 can include flexible materials, which may include, without limitation, fabrics, soft goods, and the like. The body support panel 132 can have an inner surface 132A and an outer surface 132B opposite to each other, wherein the inner surface 132A can be in contact with a child during use. The body support panel 132 can be downwardly connected with the waist pad 134, and can have an upper portion 140 that is foldable over for adjustment of the body support panel 132 to the height of the carried child. According to an example of construction, the upper portion 140 may have a plurality of stitch lines 142 extending transversally parallel to one another for facilitating folding of the upper portion 140 in sections.

A plurality of anchor structures 144 and 146 may be provided on the body support panel 132 for engagement of the attaching parts 112 and 114 provided on the carrying harness 102. For example, two anchor structures 144 transversally spaced apart from each other may be provided on the body support panel 132 at a first height relative to the waist pad 134 for respective engagement of the attaching parts 112, and two anchor structures 146 transversally spaced apart from each other may be provided on the body support panel 132 at a second height relative to the waist pad 134 for respective engagement of the attaching parts 114, the anchor structures 146 being lower than the anchor structures 144. The anchor structures 144 and 146 may exemplarily include loops sewn to the body support panel 132 on the outer surface 132B thereof. In this manner, the attaching parts 112 and 114 of the carrying harness 102 can respectively engage with the anchor structures 144 and 146 to attach the child supporting part 104 to the carrying harness 102, and can respectively disengage from the anchor structures 144 and 146 to detach the child supporting part 104 from the carrying harness 102.

Referring to FIGS. 3 and 4, the waist pad 134 is connected with the body support panel 132 and is provided with two waist straps 148 that are attachable to each other around a caregiver's waist. In this manner, the child supporting part 104 may be attached to a caregiver independently of the carrying harness 102.

The two hip support panels 136 can be connected with the body support panel 132, and can be disposed adjacent to the waist pad 134. The two hip support panels 136 are foldable over the body support panel 132, and can be unfolded and attached to the waist pad 134 to provide hip support for a child. For example, snap fasteners 150A and 150B respectively provided on the hip support panels 136 and the waist pad 134 may be engaged with each other to attach the unfolded hip support panels 136 to the waist pad 134. According to an example of construction, two snap fasteners 150A may be respectively provided at the ends of the two hip support panels 136 distant from the connecting regions where the hip support panels 136 respectively join with the body support panel 132, and two snap fasteners 150B can be respectively at two opposite ends of the waist pad 134. When the hip support panels 136 are not used, the snap fasteners 150A and 150B may be disengaged from each other so that the hip support panels 136 can be folded over the body support panel 132. For example, the hip support panels 136 may be folded over the outer surface 132B of the body support panel 132, and the snap fasteners 150A of the hip support panels 136 can respectively engage with snap fasteners 150C provided on the body support panel 132 and/or the waist pad 134 to hold the hip support panels 136 in the folded state. According to an example of construction, the snap fasteners 150C may be respectively provided on tabs that are appended to the body support panel 132 and/or the waist pad 134.

Referring to FIGS. 3 and 4, the child attachment 138 is connected with the body support panel 132, and is operable to attach the child supporting part 104 to a child around the child's waist. In particular, the child attachment 138 may be fastened to the body support panel 132 around a child's waist for holding the child supporting part 104 with the child while the child supporting part 104 is separated from the carrying harness 102. According to an embodiment, the child attachment 138 can include a crotch pad 152. The crotch pad 152 can be connected with the inner surface 132A of the body support panel 132, and may rotate relative to the body support panel 132. According to an example of construction, the crotch pad 152 may have a stem portion 154 and a transversal portion 156. The crotch pad 152 including the stem portion 154 and the transversal portion 156 may exemplarily have a T-shape. The crotch pad 152 can be connected with the body support panel 132 at one end of the stem portion 154.

The crotch pad 152 may be attached to the body support panel 132 around a child's waist for holding the child supporting part 104 with the child. According to an example of construction, the crotch pad 152 can have two transversally opposite ends respectively provided with two fastening parts 158, and the body support panel 132 can be provided with two strips 160 operable to respectively engage with the two fastening parts 158 for attaching the crotch pad 152 to the body support panel 132 around a child's waist. The fastening parts 158 may be provided on two opposite ends of the transversal portion 156 of the crotch pad 152, and may exemplarily include buttons. Each strip 160 may have one end affixed to the body support panel 132, and include a loop that can engage with or disengage from the corresponding fastening part 158.

Referring to FIGS. 3 and 4, the child supporting part 104 can include an opening 162 adapted to receive the passage of a crotch strap of a child supporting apparatus. The opening 162 can be located adjacently below the crotch pad 152, and can be provided in the body support panel 132 or the waist pad 134. According to an example of construction, the opening 162 may be disposed adjacent to a connecting region between the body support panel 132 and the waist pad 134. Moreover, the crotch pad 152 may include a slot 164 for holding a crotch strap of a child supporting apparatus with the crotch pad 152.

The child carrier 100 described herein can hold a child close to a caregiver's torso in either an inward facing position (i.e., with the child facing the caregiver) or an outward facing position (i.e., with the child facing away from the caregiver) in a hand-free way. FIG. 1 illustrates the configuration of use in which the child carrier 100 can hold a child close to a caregiver's torso in the inward facing position. In this configuration, the carrying harness 102 is installed over a caregiver's torso, the child supporting part 104 is attached to the carrying harness 102 with the attaching parts 112 and 114 of the carrying harness 102 respectively engaged with the anchor structures 144 and 146 of the child supporting part 104, and the waist pad 134 of the child supporting part 104 is fastened around the caregiver's waist. Moreover, the two hip support panels 136 can be unfolded from the body support panel 132 and attached to the waist pad 134 to provide hip support for a child. The child carrier 100 thereby configured can hold a child in the inward facing position between the child supporting part 104 and the caregiver's torso. For better supporting the child's head, the upper portion 140 of the body support panel 132 may be unfolded to cover the child's head.

Figure 5:
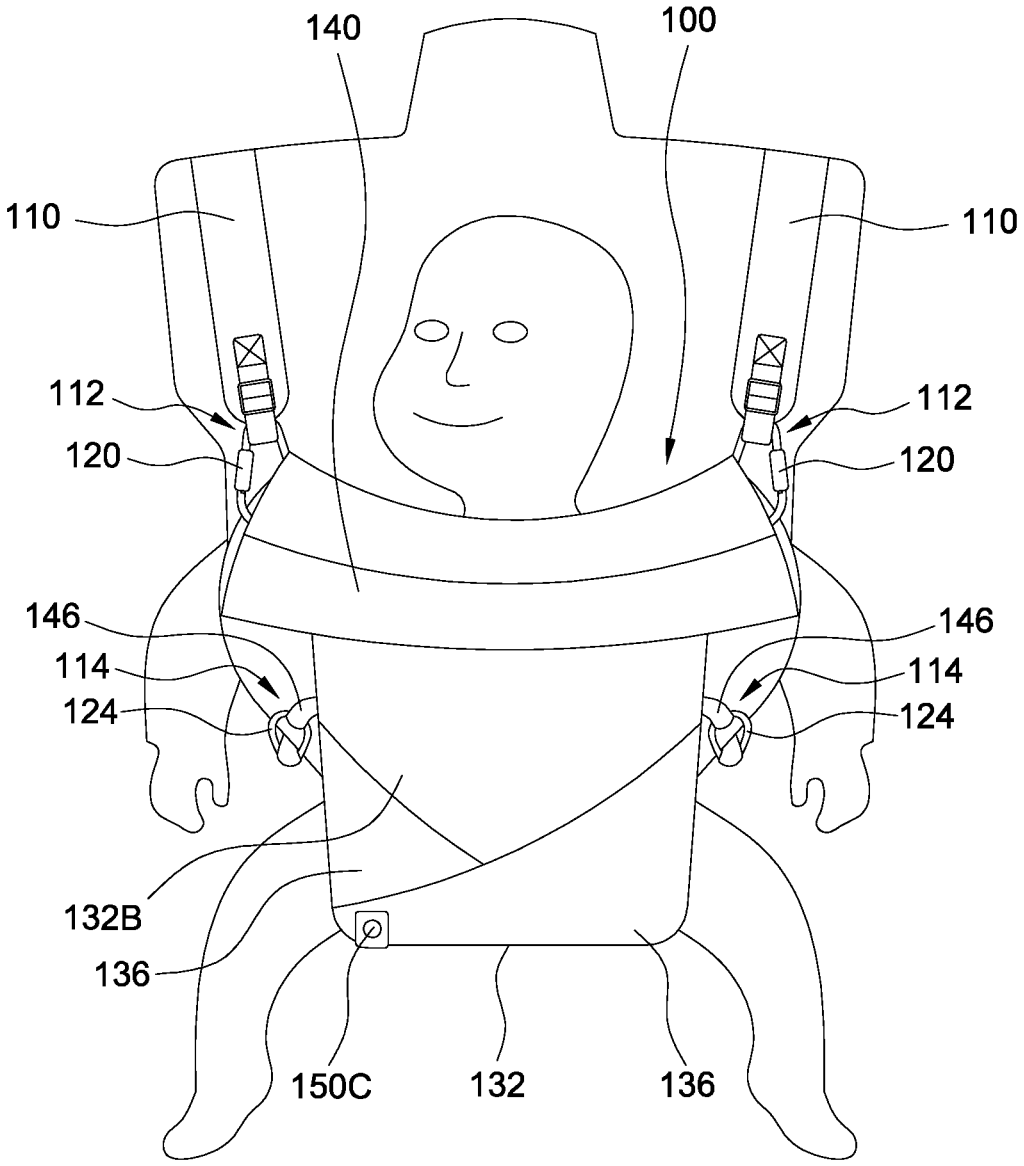
FIG. 5 is a schematic view illustrating the child carrier holding a child in an outward facing position.

FIG. 5 is a schematic view illustrating the configuration of use in which the child carrier 100 can hold a child close to a caregiver's torso in the outward facing position. In this configuration, the carrying harness 102 and the child supporting part 104 can be installed like previously described for the inward facing position. Since the child is held in the outward facing position, the two hip support panels 136 can be folded over the body support panel 132, and the upper portion 140 of the body support panel 132 may be folded downward to uncover the child's face.

In addition to the aforementioned configurations where the child carrier 100 is used to hold a child close to a caregiver, the child carrier 100 may be configurable for use in a system including a child supporting apparatus adapted to receive the child carrier 100. Examples of child supporting apparatuses that may receive the child carrier 100 can include, without limitation, child safety seats, child strollers, highchairs, child swings, and the like. In conjunction with FIGS. 2-4, FIG. 6 is a schematic view illustrating a system configuration in which the child carrier 100 can be received in a child supporting apparatus 200 that is exemplary a child safety seat.

Referring to FIGS. 2-4 and 6, the child supporting apparatus 200 can exemplary include a seat portion 202 adapted to receive a child, and a harness 204 including a crotch strap 206 and shoulder and lap straps 208 for restraining the child on the seat portion 202. The child carrier 100 can be disassembled so that the carrying harness 102 is separated from the child supporting part 104, and the child supporting part 104 can be held with the child by the child attachment 138. The child and the child supporting part 104 held at the child's back can be received on the seat portion 202, and the two waist straps 148 can be respectively received at least partially in two storage compartments 210 respectively provided at a left and a right side of the seat portion 202. In this configuration, the child supporting part 104 can provide comfortable support for the child on the seat portion 202. The harness 204 of the child supporting apparatus 200 can be fastened over the child with the crotch strap 206 of the harness 204 respectively threaded through the opening 162 of the child supporting part 104 and the slot 164 of the crotch pad 152. For a proper fastening of the harness 204 over the child's shoulder, the upper portion 140 of the body support panel 132 can be folded downward.

Figure 6:
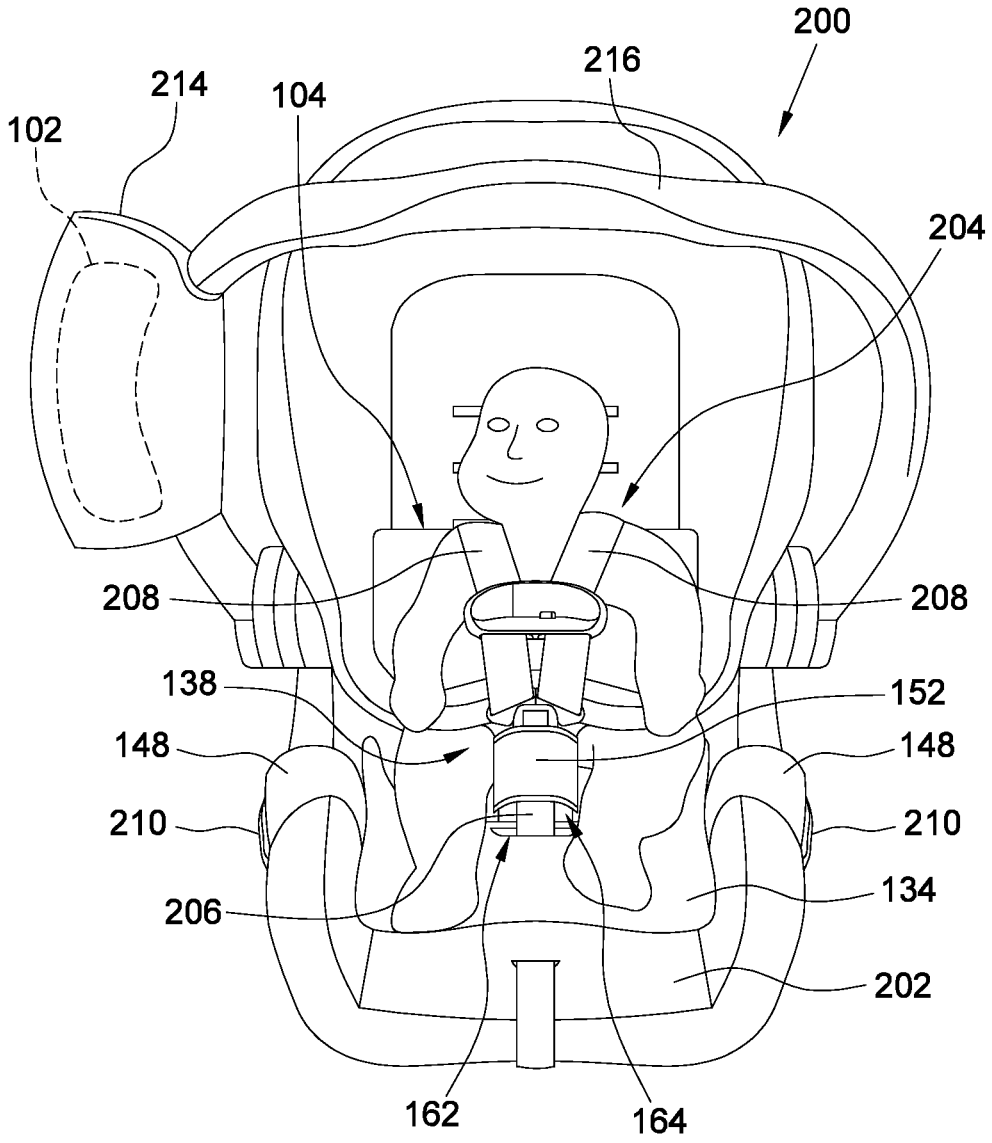
FIG. 6 is a schematic view illustrating a system configuration in which the child carrier is received in a child supporting apparatus.

Referring to FIG. 6, the child supporting apparatus 200 can include a pocket 214 for receiving the carrying harness 102 of the child carrier 100 separate from the child supporting part 104. For example, the child supporting apparatus 200 can have a carry handle 216, and the pocket 214 can be provided on the carry handle 216. According to an example of construction, the pocket 214 may be a bag removably attached to the carry handle 216.

For transitioning from the configuration of FIG. 6 to that of FIG. 1, the carrying harness 102 is removed from the pocket 214. The waist straps 148 are removed from the storage compartments 210. The harness 204 is loosened and released, and the crotch strap 206 is disengaged from the opening 162 of the child supporting part 104 and the slot 164 of the crotch pad 152. The carrying harness 102 is installed over the caregiver's torso. The child is removed from the child supporting apparatus 200 with the child supporting part 104 attached to the child. The child and the child supporting part 104 are then placed at a front of the caregiver's torso. The attaching parts 112 and 114 of the carrying harness 102 are respectively engaged with the anchor structures 144 and 146 of the child supporting part 104. The waist pad 134 and the waist straps 148 are attached around the caregiver's waist, and the hip support panels 136 are unfolded and attached to the waist pad 134. The upper portion 140 of the body support panel 132 can be unfolded to provide support for the child's head.

For transitioning from the configuration of FIG. 1 back to that of FIG. 6, the hip support panels 136 are detached from the waist pad 134 and folded inward relative to the body support panel 132. The attaching parts 112 and 114 of the carrying harness 102 are respectively disengaged from the anchor structures 144 and 146 of the child supporting part 104 while the child is held in place by the caregiver. The upper portion 140 of the body support panel 132 can be folded downward. The waist pad 134 and the waist straps 148 are detached, and the child and the child supporting part 104 are simultaneously placed on the child supporting apparatus 200 separate from the carrying harness 102. The two waist straps 148 are respectively received at least partially in the two storage compartments 210 at the left and the right side of the seat portion 202. The crotch strap 206 is threaded through the opening 162 of the child supporting part 104 and the slot 164 of the crotch pad 152 so that the harness 204 can be fastened over the child. The carrying harness 102 can be folded and stored in the pocket 214.

For transitioning from the configuration of FIG. 6 to that of FIG. 5, the carrying harness 102 is removed from the pocket 214. The waist straps 148 are removed from the storage compartments 210. The harness 204 is loosened and released, and the crotch strap 206 is disengaged from the opening 162 of the child supporting part 104 and the slot 164 of the crotch pad 152. The carrying harness 102 is installed over the caregiver's torso. The child and the child supporting part 104 are removed from the child supporting apparatus 200, either at the same time or separately. The child supporting part 104 is detached from the child, and the waist straps 148 are attached around the caregiver's waist. The upper portion 140 is folded downward as necessary for exposing the child's face. The hip support panels 136 are folded over the body support panel 132. The child is positioned facing away from the caregiver. While the caregiver holds the child in place, the body support panel 132 is wrapped around the child's body, and the attaching parts 112 and 114 of the carrying harness 102 are then respectively engaged with the anchor structures 144 and 146 of the child supporting part 104.

For transitioning from the configuration of FIG. 5 back to that of FIG. 6, the attaching parts 112 and 114 of the carrying harness 102 are respectively disengaged from the anchor structures 144 and 146 of the child supporting part 104 while the child is held in place by the caregiver. The child is then removed from the child carrier 100. The waist straps 148 are detached, and the child supporting part 104 is placed on the seat portion 202 of the child supporting apparatus 200. The two waist straps 148 are respectively placed at least partially in the two storage compartments 210 at the left and the right side of the seat portion 202, and the carrying harness 102 is stored in the pocket 214. The child is placed on the child supporting part 104 in the child supporting apparatus 200. The crotch strap 206 is then threaded through the opening 162 of the child supporting part 104 and the slot 164 of the crotch pad 152 so that the harness 204 of the child supporting apparatus 200 can be fastened over the child.

Advantages of the structures described herein include the ability to provide a child carrier that can hold a child close to a caregiver in a hand-free way and reduce disturbance when the child is transitioned between the child carrier and a child supporting apparatus.

Realization of the child carrier has been described in the context of particular embodiments. These embodiments are meant to be illustrative and not limiting. Many variations, modifications, additions, and improvements are possible. These and other variations, modifications, additions, and improvements may fall within the scope of the invention as defined in the claims that follow.

What is claimed is:

1. A child carrier comprising:

a carrying harness including a shoulder extension, the carrying harness being installable over a caregiver's torso and shoulder; and a child supporting part operable to attach to and detach from the carrying harness, wherein the child supporting part includes:

a body support panel, a crotch pad connected with the body support panel and including a stem portion and a transversal portion, and a waist belt connected with the body support panel and configured to encircle a caregiver's waist, the waist belt extending below the crotch pad, the crotch pad being configured to encircle a majority of a child's waist and extend under a child's crotch while installed to a caregiver, the body support panel of the child supporting part being configured to completely detach from the carrying harness while the crotch pad and the waist belt remain connected with the body support panel, the body support panel being configured to hold to a child while being completely detached from the carrying harness by positioning the stem portion of the crotch pad from an underside of the child's crotch between the child's two legs to the child's waist and by attaching the transversal portion of the crotch pad across the child's waist to the body support panel so that the body support panel and the stem portion of the crotch pad respectively extend at two opposite sides of the child, and the child supporting part being configured to install to a caregiver independently of the carrying harness by encircling the waist belt around the caregiver's waist.

2. The child carrier according to claim 1, wherein the crotch pad is rotatable relative to the body support panel.

3. The child carrier according to claim 1, wherein the crotch pad has two transversally opposite ends provided with two fastening parts, the crotch pad being attachable to the body support panel around a child's waist by engaging two strips provided on the body support panel with the two fastening parts.

4. The child carrier according to claim 3, wherein the two fastening parts include buttons.

5. The child carrier according to claim 1, wherein the child supporting part includes an opening adapted to receive the passage of a crotch strap of a child supporting apparatus.

6. The child carrier according to claim 5, wherein the opening is located below the crotch pad.

7. The child carrier according to claim 6, wherein the crotch pad includes a slot for holding a crotch strap of a child supporting apparatus with the crotch pad.

8. The child carrier according to claim 1, wherein the waist belt is provided with two waist straps that are attachable to each other around a caregiver's waist.

9. The child carrier according to claim 1, wherein the child supporting part further includes two hip support panels connected with the body support panel, the two hip support panels being foldable over the body support panel and unfolded and attached to the waist belt to provide hip support for a child.

10. The child carrier according to claim 1, wherein the carrying harness includes: a support panel having the shoulder extension and a second shoulder extension, a back portion, two first attaching parts respectively coupled to the two shoulder extensions, and two second attaching parts coupled to the back portion, the two first attaching parts being operable to respectively engage with or disengage from two first anchor structures provided on the child supporting part, and the two second attaching parts being operable to respectively engage with or disengage from two second anchor structures provided on the child supporting part.

11. The child carrier according to claim 10, wherein any of the first and second attaching parts include a snap link.

12. The child carrier according to claim 10, wherein any of the first and second anchor structures includes a loop.

13. The child carrier according to claim 1, being adapted to hold a child close to a caregiver in an inward facing position and an outward facing position.

14. A child supporting apparatus adapted to receive the child carrier according to claim 1, wherein the child supporting apparatus comprises a seat portion adapted to receive a child and the child supporting part of the child carrier attached to the child, and a pocket for receiving the carrying harness of the child carrier separate from the child supporting part.

15. The child supporting apparatus according to claim 14, wherein the seat portion has a left and a right side respectively provided with two storage compartments for receiving at least partially two waist straps of the child supporting part.

16. The child supporting apparatus according to claim 14, wherein the child supporting apparatus has a carry handle, the pocket being provided on the carry handle.

17. The child supporting apparatus according to claim 14, being a child safety seat.

18. The child carrier according to claim 1, wherein the waist belt comprises a waist pad and a waist strap.

19. The child carrier according to claim 1, wherein the waist belt has an upper edge connected with the body support panel, the child supporting part being configured to completely detach from the carrying harness while the crotch pad and the upper edge of the waist belt remain connected with the body support panel.

20. A child carrier comprising:

a carrying harness installable over a caregiver's torso; and a child supporting part operable to attach to and detach from the carrying harness, wherein the child supporting part includes:

a body support panel, a crotch pad connected with the body support panel and having a T-shape including a stem portion and a transversal portion, and a waist belt connected with the body support panel and configured to encircle a caregiver's waist, the waist belt extending substantially below the crotch pad, the crotch pad being configured to encircle a child's waist and extend under a child's crotch, the child carrier being configured to hold a child between the body support panel of the child supporting part and the caregiver's torso, the body support panel of the child supporting part being configured to completely detach from the carrying harness while the crotch pad and the waist belt remain connected with the body support panel, the body support panel being configured to hold to a child while being completely detached from the carrying harness by positioning the stem portion of the crotch pad from an underside of the child's crotch between the child's two legs to the child's waist and by attaching the transversal portion of the crotch pad across the child's waist to the body support panel so that the body support panel and the stem portion of the crotch pad respectively extend at two opposite sides of the child, and the child supporting part being configured to install to a caregiver independently of the carrying harness by encircling the waist belt around the caregiver's waist.

21. A child carrier comprising:

a carrying harness installable over a caregiver's torso, the carrying harness including a support panel having two shoulder extensions; and a child supporting part operable to attach to and detach from the carrying harness, wherein the child supporting part includes:

a body support panel, a crotch pad connected with the body support panel and having a T-shape including a stem portion and a transversal portion, and a waist belt connected with the body support panel and configured to encircle a caregiver's waist, the waist belt extending below the crotch pad, the crotch pad being configured to encircle a child's waist and extend under a child's crotch while installed to a caregiver, the child carrier being configured to hold a child between the body support panel of the child supporting part and the caregiver's torso, the body support panel of the child supporting part being configured to completely detach from the carrying harness while the crotch pad and the waist belt remain connected with the body support panel, the body support panel being configured to hold to a child while being completely detached from the carrying harness by positioning the stem portion of the crotch pad from an underside of the child's crotch between the child's two legs to the child's waist and by attaching the transversal portion of the crotch pad across the child's waist to the body support panel so that the body support panel and the stem portion of the crotch pad respectively extend at two opposite sides of the child, and the child supporting part being configured to install to a caregiver independently of the carrying harness by encircling the waist belt around the caregiver's waist, wherein the waist belt has an upper edge connected with the body support panel, the child supporting part being configured to completely detach from the carrying harness while the crotch pad and the upper edge of the waist belt remain connected with the body support panel.

* * * * *